United States Patent [19]

Haberhauer

[11] 4,179,600

[45] Dec. 18, 1979

[54] DEVICE FOR FUSING TONER ON A CARRIER OF ELECTROSTATIC IMAGES

[75] Inventor: Helmuth Haberhauer, Taunusstein, Fed. Rep. of Germany

[73] Assignee: Hoechst Aktiengesellschaft, Frankfurt am Main, Fed. Rep. of Germany

[21] Appl. No.: 908,957

[22] Filed: May 24, 1978

[30] Foreign Application Priority Data

May 27, 1977 [DE] Fed. Rep. of Germany ..... 2724052

[51] Int. Cl.[2] ..... H01B 1/00

[52] U.S. Cl. ..... 219/216; 219/388; 219/347; 432/59

[58] Field of Search ..... 219/216, 388, 347, 349; 355/3 FU; 432/59, 227

[56] References Cited

U.S. PATENT DOCUMENTS

| | | | |
|---|---|---|---|
| 3,079,483 | 2/1963 | Codichini et al. | 219/216 |
| 3,219,326 | 11/1965 | Hunt | 219/216 X |
| 3,642,365 | 2/1972 | Egnaczak et al. | 219/216 |

FOREIGN PATENT DOCUMENTS

| | | | |
|---|---|---|---|
| 1380112 | 1/1975 | United Kingdom | 219/216 |

OTHER PUBLICATIONS

Kruger et al., "German Printed Application", 2429734 6/74.

Nogaito et al., "German Printed Application", 2240812 8/72.

*Primary Examiner*—C. L. Albritton

*Attorney, Agent, or Firm*—Schwartz, Jeffery, Schwaab, Mack, Blumenthal & Koch

[57] ABSTRACT

A device for fusing toner on a carrier of electrostatic images, the carrier having a predetermined width and moving through a fusion zone heated by infrared radiation, the device comprising a plurality of shortwave infrared radiating means arranged above and transverse to the moving direction of the carrier, each of the radiating means having a length less than the width of the carrier, each of the radiating means being mutually unaligned with the remaining plurality of the radiating means, and wherein the ends of the infrared radiating means are interleaved in a comb-like manner in the center of the fusion zone.

14 Claims, 4 Drawing Figures

DEVICE FOR FUSING TONER ON A CARRIER OF ELECTROSTATIC IMAGES

BACKGROUND OF THE INVENTION

1. Field of the Invention

The invention relates to a device for fusing toner on a carrier of electrostatic images, the carrier migrating through a fusion zone which is heated by infrared radiation.

2. Description of the Prior Art

After electrostatic images have been developed with toner powder, it is known to fuse the powder images onto the image carrier by means of heat radiation. The image carrier can be paper, a film material, printing plates or a like material, on which the toner powder is heated above its melting point by means of a source of radiant heat and is fused on after cooling.

For this purpose, German Auslegesschrift 1,063,029 has disclosed a fixing device having a series of sources of infrared radiation, which are arranged successively in the running direction of the image carrier and each of which extends transversely to the running direction across the total width of the image carrier. A further device described in this paper for fixing the powder image consists of a single radiator which is accommodated in a reflection casing which forms an image of the heating filament of the radiant source in a focal line within the powder image. In this way, the radiant energy is concentrated onto the powder image and causes the powder to fuse without excessive heating of the image carrier. It is possible here to operate the radiant source in a pulsed manner so that the action of the infrared radiation takes place only during a very short period of time.

The heat-fixing device disclosed in German Offenlegungsschrift 1,797,010 consists of a source of radiant heat, which is surrounded by a reflector which focuses the total energy along a narrow strip transversely to the running direction of the image carrier.

An elongate heat source which is located in the interior of a drum having a shell which is transparent to heat radiation is described in German Offenlegungsschrift 1,816,174. This source of radiant heat is associated with an optical device which collects the heat radiation in an image line on the image carrier in order to warm the particles of toner to sufficient temperature and hence to soften them so that they can be fused onto the image carrier in a downstream pressure gap which is formed by a roller pressing against the drum.

The known fixing devices having sources of radiant heat which extend continuously across the width of the image carrier, have the common feature that the power of the radiators falls towards their ends. This results in a non-uniform surface temperature distribution in the direction transverse to the running direction of the image carrier, and hence the burning-in of the powder image becomes non-uniform. When a fixing device of this type is operated with material continuously passing through, there is the further disadvantage that the sources of radiant heat are always switched on and off for the same length of time, with the result that various parts of the fixing device, in spite of cooling, are gradually heated up, and this leads to different degrees of fusion of the powder images onto the image carrier. This effect is undesirable particularly in the case of printing plates as image carriers, from which a coating still has to be removed after the powder image has been fused on, since a complete removal of coating from the printing plates is no longer ensured if the powder images have been excessively burned in.

OBJECTS OF THE INVENTION

It is an object of the invention to improve a device of the type initially set forth in such a way that, when toner is fused on, a uniform temperature profile on the surface across the width of the image carrier is obtained when the image carrier runs continuously through the device.

BRIEF SUMMARY OF THE INVENTION

According to the invention, this object is achieved when several short-wave infrared radiators are arranged above and transverse to the running direction of the carrier across the width of the latter, and when the infrared radiators are not mutually aligned and each individual infrared radiator has a length which is shorter than the width of the carrier.

In order to avoid a gradually increasing heating-up of the infrared radiators during sustained operation of the fixing device, the radiators are advantageously connected to a power switch which switches them off and on; the ratio of the off-time to the on-time being varied during the running period of the device.

The invention has the advantage that, due to the special arrangement of the sources of infrared radiation, a uniform temperature distribution is obtained on the surface of the image carrier. In addition, due to the variable control of the on-time and off-time of the sources of infrared radiation, the surface temperature of the image carriers running through can be kept largely constant, both in short-period operation and in long-period operation of the device.

BRIEF DESCRIPTION OF THE DRAWINGS

In the following text, the invention is explained in more detail by reference to several figures, in which.

DETAILED DESCRIPTION OF THE PREFERRED EMBODIMENT

Figure 1:
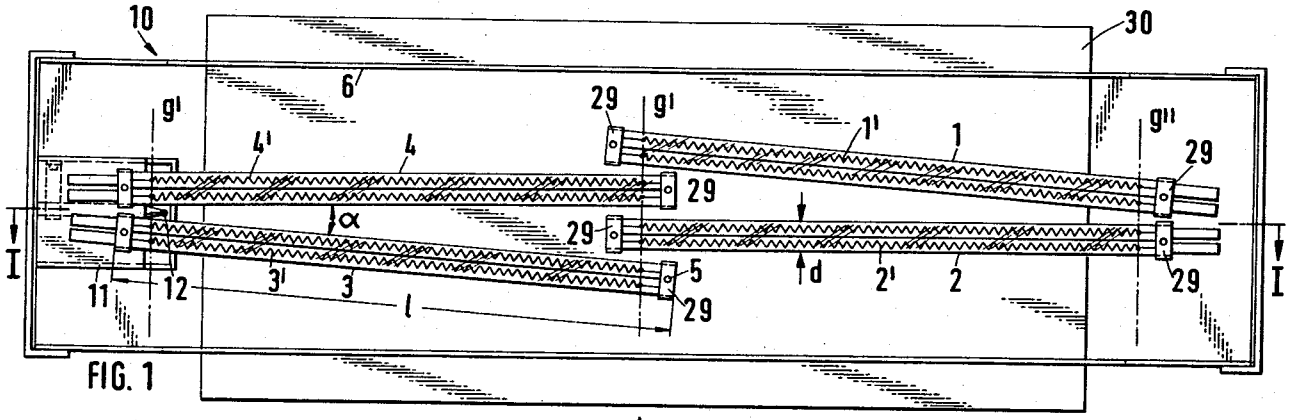
FIG. 1 shows a diagrammatic plan view of one embodiment of the invention, with the top face taken off.

The plan view in FIG. 1 shows, with the top face taken off, a device 10 for fusing toner on an image carrier 30 which preferably is a printing plate. In the illustrative embodiment shown, four infrared radiators 1, 2, 3 and 4 are provided, which are arranged above and transverse to the running direction of the carrier 30 across the width of the latter. The infrared radiators are known twin-tube infrared radiators which, particularly in short-wave infrared range, emit the radiation which fuses the toner material onto the image carrier. The length l of the individual radiators may be adapted to the particular requirement or intended purpose, for example to the width of the device 10 or to the width of the carrier 30. In contrast to the known fixing devices, however, the heated lengths of the infrared radiators 1, 2, 3 and 4, which are mounted perpendicular to the running direction are not exactly matched to the web width of the carrier 30. Each individual infrared radiator has a length which is shorter than the width B of the carrier 30 and reaches approximately a dimension which slightly exceeds half the width of the carrier 30. The infrared radiators 1, 2, 3 and 4 are not mutually aligned but are rather associated with one another in pairs and enclose an angle $\alpha$ which opens, starting from the small faces of the device 10, towards the center of the fusion zone.

To ensure that the edge parts of the carrier 30 are also satisfactorily warmed, the heated lengths of the infrared radiators 1, 2, 3 and 4 project beyond the web width of the carrier 30 a short distance, for example, at least 50 to 100 mm. The ends of the infrared radiators 1, 2, 3 and 4 are inserted into holders 29 and are held by spring clips 5. As can be seen from FIG. 2, these holders are fastened in a top face 31 and are variable in height with the aid of adjustments 9. The individual infrared radiators are suspended at both ends by the holders 29, further supports are not necessary since the quartz glass tube of the individual radiator is self-supporting.

It is obvious that the angle $\alpha$ between the infrared radiators 1, 2 or 3, 4, which are mutually associated in pairs, depends on the length l and the diameter d of the individual infrared radiator. The longer the radiator and the larger the diameter of the individual infrared radiator, the larger the angle $\alpha$ must be so that the ends of the infrared radiators 1, 2, 3 and 4 can interlock in the manner of a comb in the center of the fusion zone of the device 10. Thus, the angle $\alpha$ cannot become zero and, in general, it may be as large as 15°.

The coiled heating filaments 1', 2', 3' and 4' of the infrared radiators 1, 2, 3 and 4 end a little before the holders 29. The infrared radiators 1, 2, 3 and 4 are arranged in such a manner that the ends of the coiled heating filaments 1', 2', 3' and 4' are located in each case on a line g, g' or g'', which extends parallel to the running direction A of the carrier 30, at the edges and in the center of the fusion zone respectively.

It is self-evident that it is also possible to provide more than four infrared radiators in the device 10. If a number of shorter infrared radiators is used in place of one radiator which extends over the complete width of the image carrier or the printing plate, the decrease in radiation at the ends of each radiator is compensated so that a uniform temperature profile is obtained on the surface of the carrier 30.

A mirror surface 6 closes off the longitudinal sides of the device 10 and reflects the incident infrared radiation back into the interior of the device 10. Appropriately, the inside of the top face 31 is also metallized so that the infrared radiation emitted upwards is reflected again in the direction of the carrier 30. As can be seen from FIG. 2, the height of the top face 31 can be adjusted with the aid of height adjustments 7 and 8 which consist, for example, of threaded bolts 34 which are fixed to the upper side of the top face 31 and which pass through a casing wall 32 and are in engagement with a knurled screw 33. The entire radiator arrangement can then be shifted vertically upwards or downwards together with the top face 31.

The adjustments 9 at the ends of each individual infrared radiator are maintained at different settings in such a way that the infrared radiator extends obliquely upwards from the edges of the fusion zone of the device 10 towards the center. Its inclination to the horizontal may thus be adjusted in a range from 0° to 5°. As a result of the oblique position of the infrared radiators with respect to the horizontal and as a result of their arrangement at an angle, which differs from a right angle, to the running direction A of the carrier 30, it is possible to produce a largely uniform temperature profile on the surface of the carrier 30, without non-uniformities in the temperature distribution. Such non-uniformities normally give rise to rippling of the surface of the carrier 30 at any point of the surface where temperature peaks occur.

Figure 2:
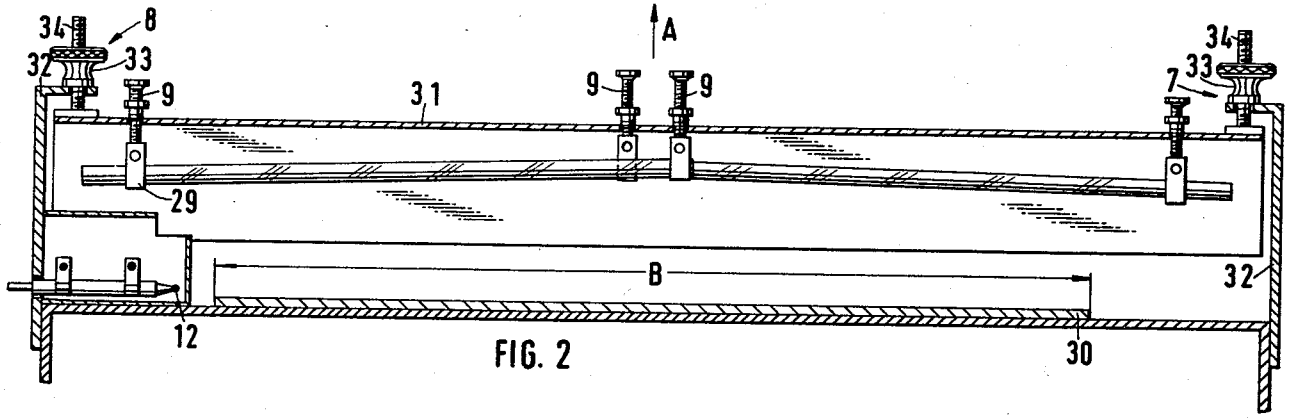
FIG. 2 shows a sectional view of the device according to FIG. 1, along the line I—I.

To measure the temperature of the surface of the carrier 30, a temperature sensor 12 is provided, as shown in FIGS. 1 and 2, at approximately the height of the surface of the carrier 30 and on the side thereof. The temperature sensor 12 is located in a casing 11 which opens upwards towards the infrared radiators 1, 2, 3 and 4. This sensor is a well-known thermocouple, for example a NiCr-Ni couple, a Feconstantan couple of a PtRh-Pt couple. For example, the temperature sensor 12 may be located between the two infrared radiators 3 and 4 and close to their ends in such a way that it is still within the range of the coiled heating filaments 3' and 4' of the two infrared radiators. As a result, the temperature sensor 12 receives the same intensity of radiation as the surface of the carrier 30 so that the surface temperature of the latter is measured with a high degree of accuracy. The casing 11 serves to prevent the temperature sensor 12 from responding to movements of cooling air from a fan which is located downstream of the device 10 and is not shown.

Figure 3:
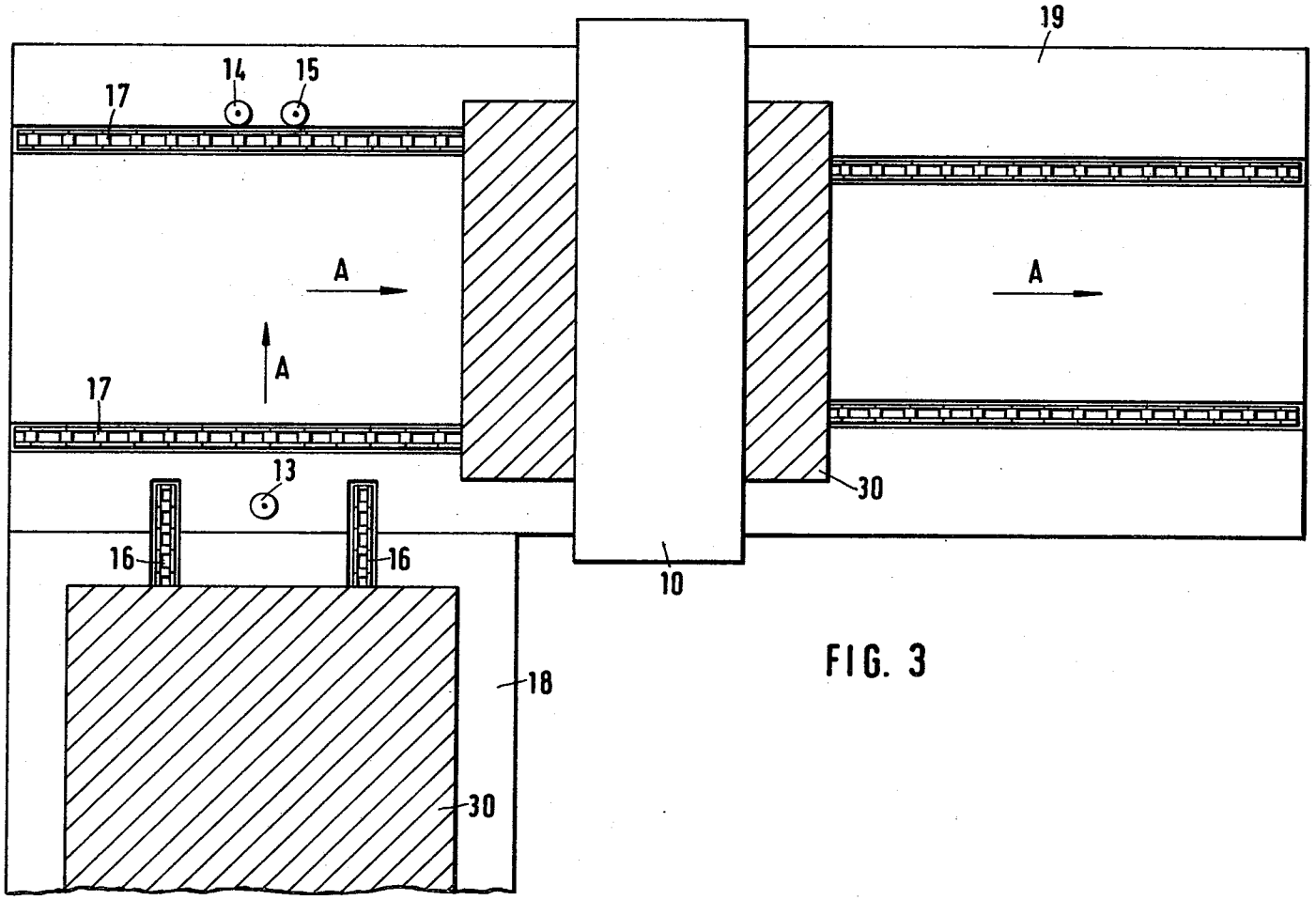
FIG. 3 shows, in diagrammatic plan view, a segment of a processing line for image carriers, in which the device forms one of the processing stations.

The device 10 is one of the working stations of a processing line, along which the carrier 30 is moved. A segment of this processing line is shown diagrammatically in FIG. 3. Parts 18 and 19 of the line are disposed relative to one another at a right angle. The carrier 30, for example a printing plate, is conveyed from a toner applicator (not shown) to the part 19 of the line by a drive 16 which may be a pair of revolving, continuous chains or belts. Initially, the drive 17 of this part 19 is at a standstill and it comprises, similar to the drive 16, a pair of continuously revolving chains, belts or the like. As soon as the leading edge of the carrier 30 actuates a first switch 13 which is located in the region of the line of the part 19, the infrared radiators 1, 2, 3 and 4 are turned on. The carrier 30 is conveyed onwards by the drive 16 and triggers a second switch 14 and a third switch 15. The second switch 14 stops the drive 16 and the third switch 15 switches on the drive 17 of the part 19 of the line, through which the printing plate is then moved in the running direction A, towards the device 10. In FIG. 3, two printing plates are shown, one of which is just moving through the device 10, whilst the other is being fed in on the part 18 of the line. In the case where the image carrier 30 represents printing plates, the device 10 can be followed by a device (not shown) for removing coating from these printing plates. The switches 13, 14 and 15 may be designed as micro-switches.

Figure 4:
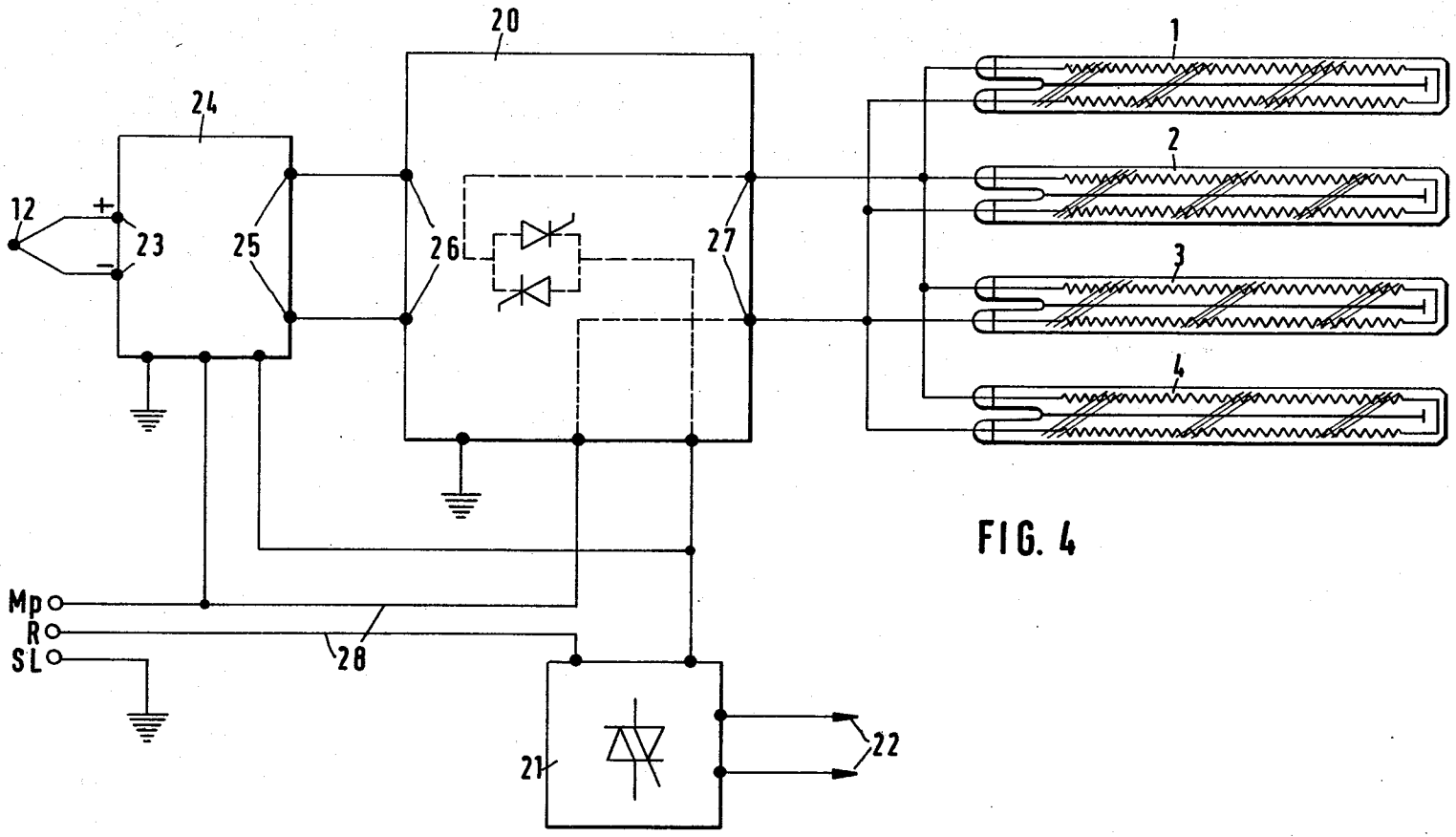
FIG. 4 shows a block diagram for the control of the on-time and off-time of the sources of radiant heat of the device.

The temperature control of the device 10 is explained in more detail by reference to the block circuit diagram according to FIG. 4. The temperature sensor 12 is connected via input terminals 23 to a temperature control unit 24, the output terminals 25 of which are connected to a power switch 20 which may, for example, be a thyristor power regulator. The power switch 20 and the temperature control unit 24 are commercially available components and are therefore not described in further detail. The voltage supply to these two components and to a relay 21 is transmitted via lines 28. The relay 21, for example, may be constructed from semi-conductors and triggered via lines 22. The infrared radiators 1 to 4 of the device 10 are connected to the output terminals 27 of the power switch 20.

The temperature measured by the temperature sensor 12 provides a measured signal as an actual value which is compared in the temperature control unit 24 with a predetermined set value. The difference between the actual value and the set value gives the control signal for the power switch 20 which switches the infrared radiators 1 to 4 on or off, corresponding to the sign of the control signal. The relay 21 is triggered by a mains set which is not shown. The power switch 20 is pre-programmed by a predetermined pulse pack and it opens and closes for a period of time which corresponds to the number of pulses in a section of the pulse train or to the interval between two successive sections of the pulse train. The predetermining of a pulse pack of this type yields the result that the ratio of the on-time to the off-time of the infrared radiators 1 to 4 can be steadily varied in such a way that, in continuous operation of the device 10, the surface temperature of each carrier 30 passing through the device remains constant. In this way, gradual heating-up of the infrared radiators 1 to 4 and of the parts of the device in proximity thereto is avoided; the result of this gradual heating-up normally is a rise of the surface temperature of successive carriers as compared with the carriers which initially run through the device 10. This steady variation of the ratio of the on-time to the off-time of the infrared radiators 1 to 4 means, for example, that, in prolonged continuous operation of the device 10, the infrared radiators remain switched off per unit time for a longer period than in the case of short-period operation of the device 10.

What is claimed is:

1. A device for fusing toner on a carrier of electrostatic images, said carrier having a predetermined width and moving through a fusion zone heated by infrared radiation, said device comprising a plurality of short-wave infrared radiating means arranged above and transverse to said moving direction of said carrier, each of said radiating means having a length less than the width of said carrier, each of said radiating means being mutually unaligned with the remaining plurality of said radiating means, and wherein the ends of said infrared radiating means are interleaved in a comb-like manner in the center of said fusion zone.

2. The device as recited in claim 1, further comprising switching means for switching power off and on to said radiating means, wherein the ratio of said off-time to said on-time is varied during the operation of the device.

3. The device as recited in claim 1, in which each of said infrared radiating means comprises coiled heating elements.

4. The device as recited in claim 3 wherein each of the ends of said coiled heating elements is arranged on a line parallel to said moving direction of said carrier, at the edges and in the center of said fusion zone.

5. The device as recited in claim 1, in which said plurality of radiating means comprises a plurality of mutually associated pairs, each of said pairs of radiating means enclosing a predetermined angle which opens towards the center of said fusion zone.

6. The device as recited in claim 5, wherein said predetermined angle comprises an angle between 0 and 15 degrees.

7. The device as recited in claim 1, further comprising a holder fastened to a top face of said device and being adjustable in height, to which said ends of said radiating means are attached.

8. The device as recited in claim 7, wherein said holder is adjustable in height in such a manner that said radiating means extend obliquely upwards from the edges of said fusion zone towards the center of said fusion zone.

9. The device as recited in claim 8, wherein said height is adjustable such that the inclination of said radiating means may be adjusted from 0 to 15 degrees to the horizontal.

10. The device as recited in claim 1, wherein each of said infrared radiating means is of the twin-tube type.

11. The device as recited in claim 7, wherein the height of said top face from said carrier is adjustable.

12. The device as recited in claim 2, further comprising a temperature sensing means located at the height of the surface of said carrier, and at a side thereof in a partially enclosed casing open at the top towards said radiating means, for providing an output signal corresponding to the temperature at said carrier.

13. The device as recited in claim 12, further comprising temperature controlling means connected between said temperature sensing means and said switching means for comparing said output signal of said sensing means to a set of predetermined values and producing therefrom a control signal for operating said switching means.

14. The device as recited in claim 13, wherein said switching means comprises:

a preset pulse pack control; and a thyristor-power regulator which switches said plurality of infrared heating means on and off in response to said preset pulse pack control;

wherein the ratio of the on-time to the off-time of said radiating means is steadily varied such that in continuous operation of said device, the surface temperature of each carrier moving through said fusion zone remains constant.

* * * * *

UNITED STATES PATENT AND TRADEMARK OFFICE

CERTIFICATE OF CORRECTION

PATENT NO. : 4,179,600

DATED : December 18, 1979

INVENTOR(S) : Helmuth HABERHAUER

It is certified that error appears in the above-identified patent and that said Letters Patent are hereby corrected as shown below:

Column 4, line 19, "of" should be --or--.

Column 6, claim 9, line 27, "15" should be --5--.

Signed and Sealed this

*Twenty-eighth* Day of *October 1980*

[SEAL]

*Attest:*

SIDNEY A. DIAMOND

*Attesting Officer*

*Commissioner of Patents and Trademarks*